US009747835B2

(12) United States Patent
Lee et al.

(10) Patent No.: US 9,747,835 B2
(45) Date of Patent: Aug. 29, 2017

(54) ORGANIC LIGHT-EMITTING DIODE (OLED) DISPLAY PANEL AND OLED DISPLAY HAVING THE SAME

(71) Applicant: Samsung Display Co., Ltd., Yongin, Gyeonggi-do (KR)

(72) Inventors: Seung-Kyu Lee, Asan-si (KR); Chae-Han Hyun, Suwon-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 226 days.

(21) Appl. No.: 14/592,771

(22) Filed: Jan. 8, 2015

(65) Prior Publication Data

US 2016/0012773 A1 Jan. 14, 2016

(30) Foreign Application Priority Data

Jul. 8, 2014 (KR) ..... 10-2014-0085489

(51) Int. Cl.
*G09G 5/10* (2006.01)
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2300/0804* (2013.01); *G09G 2330/08* (2013.01); *G09G 2330/10* (2013.01)

(58) Field of Classification Search
CPC ..... G09G 2330/08; G09G 2330/10; G09G 2330/12
USPC ..... 345/690
See application file for complete search history.

(56) References Cited

U.S. PATENT DOCUMENTS

2007/0296651 A1 12/2007 Kim et al.
2015/0243214 A1* 8/2015 Jeong ..... G09G 3/3233 345/214

FOREIGN PATENT DOCUMENTS

KR 10-2006-0000988 A 1/2006
KR 10-2008-0000294 A 1/2008
KR 10-2008-0000313 A 1/2008
KR 10-2008-0024009 A 3/2008

* cited by examiner

*Primary Examiner* — Gustavo Polo
(74) *Attorney, Agent, or Firm* — Knobbe Martens Olson & Bear LLP

(57) ABSTRACT

An organic light-emitting diode (OLED) display panel is disclosed. In one aspect, the OLED display panel includes a substrate including a display region and a peripheral region surrounding the display region. The panel further includes a plurality of OLEDs formed in the display region, a plurality of pixel circuits formed in the display region, and a pixel repair circuit formed in the peripheral region. When one of the pixel circuits is a dead pixel circuit, the dead pixel circuit is disconnected from a corresponding dead pixel OLED and the dead pixel OLED is connected to the pixel repair circuit via a corresponding repair line. The pixel repair circuit is configured to provide the dead pixel OLED with a grayscale repair current for representing a grayscale of the image and a compensation repair current for compensating a line load of the repair line.

20 Claims, 10 Drawing Sheets

ORGANIC LIGHT-EMITTING DIODE (OLED) DISPLAY PANEL AND OLED DISPLAY HAVING THE SAME

CROSS-REFERENCE TO RELATED APPLICATIONS

This application claims priority under 35 USC §119 to Korean Patent Applications No. 10-2014-0085489, filed on Jul. 8, 2014 in the Korean Intellectual Property Office (KIPO), the contents of which are incorporated herein in its entirety by reference.

BACKGROUND

Field

The described technology generally relates to an organic light-emitting diode (OLED) display panel and an OLED display having the OLED display panel.

Description of the Related Technology

OLEDs include an organic layer formed between two electrodes, namely, an anode and a cathode. Positive holes supplied from the anode are combined with electrons supplied from the cathode in the organic layer to emit light. OLEDs have a variety of advantages over traditional flat panel displays such as wide viewing angles, quick response speeds, relatively thin profile, and low power consumption.

SUMMARY OF CERTAIN INVENTIVE ASPECTS

One inventive aspect is an OLED display panel that can repair dead pixels and accurately display images.

Another aspect is an OLED display including the OLED display panel.

Another aspect is an OLED display panel including a substrate including a display region where an image is displayed and a peripheral region surrounding the display region, a display pixel part located in the display region, the display pixel part including a plurality of OLEDs and a plurality of display pixel circuits respectively connected to the OLEDs, and a repair pixel part located in the peripheral region. If at least one of the display pixel circuits is a dead pixel circuit, the dead pixel circuit may be disconnected from a corresponding one of the OLEDs, and the corresponding one of the OLEDs may be connected to a repair line. The repair pixel part may provide the corresponding one of the OLEDs with a grayscale repair current for representing a grayscale of the image and a compensation repair current for compensating a line load of the repair line via the repair line.

In example embodiments, the repair pixel part may include first through (n)th grayscale repair pixel circuits receiving first through (n)th scan signals, respectively, one of the first through (n)th grayscale repair pixel circuits connected to the repair line providing the grayscale repair current to the corresponding one of the OLEDs in response to a corresponding one of the first through (n)th scan signals, where n is an integer greater than 1, and first through (n)th compensation repair pixel circuits receiving the first through (n)th scan signals, respectively, one of the first through (n)th compensation repair pixel circuits connected to the repair line providing the compensation repair current to the corresponding one of the OLEDs in response to the corresponding one of the first through (n)th scan signals.

In example embodiments, a (k)th one of the first through (n)th grayscale repair pixel circuits receiving a (k)th one of the first through (n)th scan signals and a (k)th one of the first through (n)th compensation repair pixel circuits receiving the (k)th one of the first through (n)th scan signals may be connected to a same repair line, where k is an integer greater than or equal to 1 and less than or equal to n.

In example embodiments, a same data signal may be applied to the dead pixel circuit and the one of the first through (n)th grayscale repair pixel circuits connected to the repair line.

In example embodiments, a same data line may be connected to the dead pixel circuit and the one of the first through (n)th grayscale repair pixel circuits connected to the repair line.

In example embodiments, the one of the first through (n)th grayscale repair pixel circuits connected to the repair line may have a same structure as the dead pixel circuit.

In example embodiments, a structure of the one of the first through (n)th grayscale repair pixel circuits connected to the repair line may be different from a structure of the dead pixel circuit.

In example embodiments, the repair pixel part may include first through (n)th repair pixel circuits receiving first through (n)th scan signals, respectively, each of the first through (n)th repair pixel circuits generating the grayscale repair current or the compensation repair current, where n is an integer greater than 1.

In example embodiments, a (k)th one of the first through (n)th scan signals may be applied to a (k)th one of the first through (n)th repair pixel circuits and the dead pixel circuit, where k is an integer greater than or equal to 2, and less than or equal to n. The (k)th one of the first through (n)th repair pixel circuits may provide the grayscale repair current to the corresponding one of the OLEDs. And, a (k−1)th one of the first through (n)th repair pixel circuits to which a (k−1)th one of the first through (n)th scan signals may be applied provides the compensation repair current to the corresponding one of the OLEDs.

In example embodiments, a compensation voltage for generating the compensation repair current may be applied to the (k−1)th one of the first through (n)th repair pixel circuits in response to the (k−1)th one of the first through (n)th scan signals. And, a grayscale voltage for generating the grayscale repair current may be applied to the (k)th one of the first through (n)th repair pixel circuits in response to the (k)th one of the first through (n)th scan signals.

In example embodiments, a (k)th one of the first through (n)th scan signals may be applied to a (k)th one of the first through (n)th repair pixel circuits and the dead pixel circuit, where k is an integer greater than or equal to 1 and less than or equal to n−1. The (k)th one of the first through (n)th repair pixel circuits may provide the grayscale repair current to the corresponding one of the OLEDs. And, a (k+1)th one of the first through (n)th repair pixel circuits to which a (k+1)th one of the first through (n)th scan signals is applied may provide the compensation repair current to the corresponding one of the OLEDs.

In example embodiments, a grayscale voltage for generating the grayscale repair current may be applied to the (k)th one of the first through (n)th repair pixel circuits in response to the (k)th one of the first through (n)th scan signals. And, a compensation voltage for generating the compensation repair current may be applied to the (k+1)th one of the first through (n)th repair pixel circuits in response to the (k+1)th one of the first through (n)th scan signals.

In example embodiments, the magnitude of current losses occurring in the repair line may substantially equal to the magnitude of the compensation repair current.

In example embodiments, the peripheral region may include a first peripheral region and a second peripheral region that are adjacent to opposing sides of the display region facing each other. And, the repair pixel part may be located in the first peripheral region and the second peripheral region.

In example embodiments, the repair pixel part may include first through (r*n)th grayscale repair pixel circuits located in the first peripheral region, where n is an integer greater than 1, and r is an integer greater than 1, (r*n+1)th through (2r*n)th grayscale repair pixel circuits located in the second peripheral region, first through (r*n)th compensation repair pixel circuits located in the first second peripheral region, and (r*n+1)th through (2r*n)th compensation repair pixel circuits located in the second peripheral region.

In example embodiments, the repair pixel part may include first through (r*n)th repair pixel circuits located in the first peripheral region, where n is an integer greater than 1 and r is an integer greater than 1, and (r*n+1)th through (2r*n)th repair pixel circuits located in the second peripheral region.

Another aspect is an OLED display including an OLED display panel, a scan driving unit, a data driving unit, and a timing control unit. The OLED display panel may include a substrate including a display region where an image is displayed and a peripheral region surrounding the display region, a display pixel part located in the display region, the display pixel part including a plurality of OLEDs and a plurality of display pixel circuits respectively connected to the OLEDs, and a repair pixel part located in the peripheral region. If at least one of the display pixel circuits is a dead pixel circuit, the dead pixel circuit may be disconnected from a corresponding one of the OLEDs, and the corresponding one of the OLEDs may be connected to a repair line. And, the repair pixel part may provide the corresponding one of the OLEDs with a grayscale repair current for representing a grayscale of the image and a compensation repair current for compensating a line load of the repair line via the repair line.

In example embodiments, the magnitude of current losses occurring in the repair line may substantially equal to the magnitude of the compensation repair current.

In example embodiments, the repair pixel part may include first through (n)th grayscale repair pixel circuits receiving first through (n)th scan signals, respectively, one of the first through (n)th grayscale repair pixel circuits connected to the repair line providing the grayscale repair current to the corresponding one of the OLEDs in response to a corresponding one of the first through (n)th scan signals, where n is an integer greater than 1, and first through (n)th compensation repair pixel circuits receiving the first through (n)th scan signals, respectively, one of the first through (n)th compensation repair pixel circuits connected to the repair line providing the compensation repair current to the corresponding one of the OLEDs in response to the corresponding one of the first through (n)th scan signals.

In example embodiments, the repair pixel part may include first through (n)th repair pixel circuits receiving first through (n)th scan signals, respectively, each of the first through (n)th repair pixel circuits generating the grayscale repair current or the compensation repair current, where n is an integer greater than 1.

Another aspect is an OLED display panel comprising a substrate including a display region configured to display an image and a peripheral region surrounding the display region; a plurality of OLEDs formed in the display region; a plurality of pixel circuits formed in the display region and respectively connected to the OLEDs; a pixel repair circuit formed in the peripheral region; and a plurality of repair lines that extend between the pixel repair circuit and the OLEDs, wherein, when one of the pixel circuits is a dead pixel circuit, the dead pixel circuit is disconnected from a corresponding dead pixel OLED and the dead pixel OLED is connected to a corresponding repair line, and wherein the pixel repair circuit is configured to provide the dead pixel OLED with i) a grayscale repair current for representing a grayscale of the image and ii) a compensation repair current for compensating a line load of the repair line.

In example embodiments, the pixel repair circuit comprises first through (n)th grayscale pixel repair circuits configured to respectively receive first through (n)th scan signals, wherein one of the grayscale pixel repair circuits is i) connected to the dead pixel OLED via the corresponding repair line and ii) configured to provide the grayscale repair current to the dead pixel OLED in response to the corresponding scan signal, where n is an integer greater than 1; and first through (n)th compensation pixel repair circuits configured to respectively receive the scan signals, wherein one of the compensation pixel repair circuits is i) connected to the dead pixel OLED via the corresponding repair line and ii) configured to provide the compensation repair current to the dead pixel OLED in response to the corresponding scan signal.

In example embodiments, a (k)th grayscale pixel repair circuit is configured to receive a (k)th scan signal, a (k)th compensation pixel repair circuit is configured to receive the (k)th scan signal, and the (k)th grayscale pixel repair circuit and the (k)th compensation pixel repair circuit are connected to the same repair line, where k is an integer greater than or equal to 1 and less than or equal to n. The dead pixel circuit can be configured to receive a data signal and the one of the grayscale repair pixel circuits can be configured to receive the data signal. A data line can be connected to the dead pixel circuit and the one of the grayscale repair pixel circuits. The one of the first grayscale repair pixel circuits can have substantially the same structure as the dead pixel circuit. The one of the grayscale repair pixel circuits can have a different structure from that of the dead pixel circuit.

In example embodiments, the pixel repair circuit includes first through (n)th sub-pixel repair circuits configured to respectively receive first through (n)th scan signals, wherein each of the sub-pixel repair circuits is configured to generate a corresponding grayscale repair current or a corresponding compensation repair current, where n is an integer greater than 1.

In example embodiments, a (k)th sub-pixel repair circuit is configured to receive a (k)th scan signal, wherein the dead pixel circuit is configured to receive the (k)th scan signal, where k is an integer greater than or equal to 2 and less than or equal to n, the (k)th sub-pixel repair circuit is further configured to provide the grayscale repair current to the dead pixel OLED, and a (k−1)th sub-pixel repair circuit is configured to: i) receive a (k−1)th scan signal and ii) provide the compensation repair current to the dead pixel OLED. The (k−1)th sub-pixel repair circuit can be further configured to receive a compensation voltage for generating the compensation repair current in response to the (k−1)th scan signal and the (k)th sub-pixel repair circuit can be further configured to receive a grayscale voltage for generating the grayscale repair current in response to the (k)th scan signal.

In example embodiments, a (k)th sub-pixel repair circuit is configured to receive a (k)th scan signal, wherein the dead pixel circuit is configured to receive the (k)th scan signal, where k is an integer greater than or equal to 1 and less than or equal to n−1, the (k)th sub-pixel repair circuit is further configured to provide the grayscale repair current to the dead pixel OLED, and a (k+1)th sub-pixel repair circuit is configured to i) receive a (k+1)th scan signal and ii) provide the compensation repair current to the dead pixel OLED. The (k)th sub-pixel repair circuit can be further configured to receive a grayscale voltage for generating the grayscale repair current in response to the (k)th scan signal and the (k+1)th sub-pixel repair circuit can be further configured to receive a compensation voltage for generating the compensation repair current in response to the (k+1)th scan signal.

In example embodiments, the magnitude of current losses occurring in the repair line is substantially equal to the magnitude of the compensation repair current. The peripheral region can include a first peripheral region and a second peripheral region that are respectively adjacent to opposing sides of the display region and the repair pixel circuit can be located in the each of the first and second peripheral regions.

In example embodiments, the repair pixel circuit comprises first through (r*n)th grayscale pixel repair circuits located in the first peripheral region, where n is an integer greater than 1 and r is an integer greater than 1; (r*n+1)th through (2r*n)th grayscale pixel repair circuits located in the second peripheral region; first through (r*n)th compensation pixel repair circuits located in the first peripheral region; and (r*n+1)th through (2r*n)th compensation pixel repair circuits located in the second peripheral region. The repair pixel circuit can comprise first through (r*n)th sub-pixel repair circuits located in the first peripheral region, where n is an integer greater than 1 and r is an integer greater than 1; and (r*n+1)th through (2r*n)th sub-pixel repair circuits located in the second peripheral region.

Another aspect is an OLED display comprising an OLED display panel; a scan driver; a data driver; and a timing controller, wherein the OLED display panel includes: a substrate including a display region configured to display an image and a peripheral region surrounding the display region; a plurality of OLEDs formed in the display region; a plurality of pixel circuits formed in the display region and respectively connected to the OLEDs; a pixel repair circuit located in the peripheral region; and a plurality of repair lines that extend between the pixel repair circuit and the OLEDs, wherein, when one of the pixel circuits is a dead pixel circuit, the dead pixel circuit is disconnected from a corresponding dead pixel OLED and the dead pixel OLED is connected to a corresponding repair line, and wherein the pixel repair circuit is configured to provide the dead pixel OLED with i) a grayscale repair current for representing a grayscale of the image and ii) a compensation repair current for compensating a line load of the repair line.

In example embodiments, the magnitude of current losses occurring in the repair line is substantially equal to the magnitude of the compensation repair current.

In example embodiments, the pixel repair circuit comprises first through (n)th grayscale pixel repair circuits configured to respectively receive first through (n)th scan signals, wherein one of the grayscale pixel repair circuits is i) connected to the dead pixel OLED via the corresponding the repair and ii) configured to provide the grayscale repair current to the dead pixel OLED in response to the corresponding scan signal, where n is an integer greater than 1; and first through (n)th compensation pixel repair circuits configured to respectively receive the scan signals, wherein one of the compensation pixel repair circuits is i) connected to the dead pixel OLED via the corresponding repair line and ii) configured to provide the compensation repair current to the dead pixel OLED in response to the corresponding scan signal.

In example embodiments, the pixel repair circuit comprises first through (n)th sub-pixel repair circuits respectively configured to receive first through (n)th scan signals, wherein each of the sub-pixel repair circuits is configured to generate a corresponding grayscale repair current or a corresponding compensation repair current, where n is an integer greater than 1.

Therefore, an OLED panel according to at least one embodiment can repair dead pixels using the repair pixel part providing a grayscale repair current and a compensation repair current. The repaired pixel accurately displays the image, thereby preventing the dead pixel from being recognized by a viewer as a dark pixel or a bright pixel.

In addition, an OLED display having the OLED display panel according to at least one embodiment can improve productivity and quality of the manufacturing process by repairing dead pixels.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF CERTAIN INVENTIVE EMBODIMENTS

Dead pixels may be formed in an organic light-emitting diode (OLED) display due to defects such as broken lines, short-circuits, etc. In some situations, dead pixels can be brighter than other pixels. Therefore, methods of detecting dead pixels and transforming the dead pixels into dark pixels using laser irradiation are being developed to improve productivity and effectiveness of OLED displays. However, after transforming the dead pixels into dark pixels the display quality of the OLED display is degraded since the dark pixels do not contribute to the display of an image.

Exemplary embodiments will be described more fully hereinafter with reference to the accompanying drawings, in which various embodiments are shown.

Figure 1:
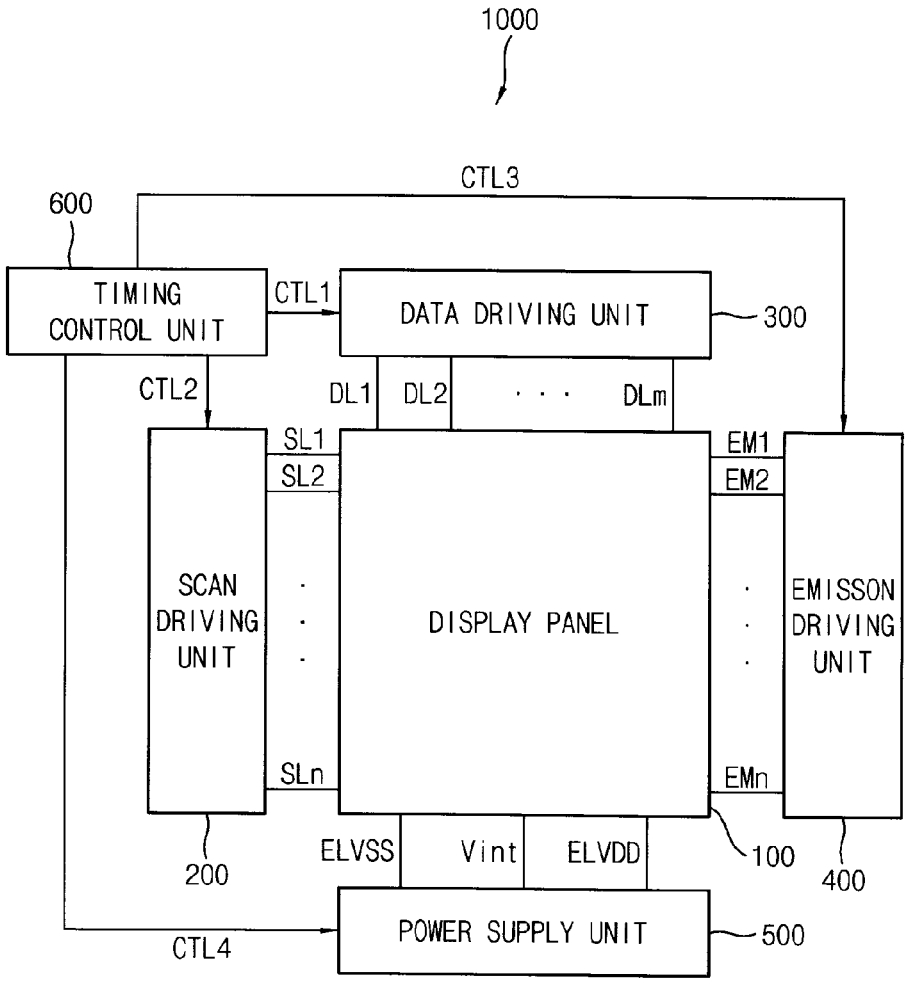
FIG. 1 is a block diagram illustrating an OLED display according to example embodiments.

FIG. 1 is a block diagram illustrating an OLED display according to example embodiments.

Referring to FIG. 1, the OLED display 1000 includes an OLED display panel 100, a scan driving unit or scan driver 200, a data driving unit or data driver 300, an emission driving unit or emission driver 400, a power supply unit or power supply 500, and a timing control unit or timing controller 600.

The OLED display panel 100 is connected to the scan driving unit 200 via scan lines SL1 through SLn. The OLED display panel 100 is connected to the data driving unit 300 via data lines DL1 through DLn. Also, the OLED display panel 100 is connected to the emission driving unit 400 via emission lines EM1 through EMn. The OLED display 1000 includes n*m display pixel circuits since the display pixel circuits are arranged at locations corresponding to the intersections between the scan lines SL1 through SLn and the data lines DL1 through DLm.

The OLED display panel 100 can be divided into a display region where an image is displayed and a peripheral region surrounding the display region. The OLED display panel 100 includes a display pixel part located in the display region and a repair pixel part or pixel repair circuit located in the peripheral region. The display pixel part includes a plurality of OLEDs and a plurality of display pixel circuits respectively connected to the OLEDs. If at least one of the display pixel circuits is a dead pixel circuit, the dead pixel circuit can be disconnected from the corresponding OLED and the corresponding OLED (hereinafter, referred to as "the OLED of the dead pixel" or "dead pixel OLED") is connected to a repair line. The repair pixel part provides the OLED of the dead pixel with a grayscale repair current for representing a grayscale of the image and a compensation repair current for compensating a line load of the repair line via the repair line. In one example embodiment, the magnitude of current losses occurring in the repair line is substantially equal to the magnitude of the compensation repair current. Therefore, the OLED display panel 100 can repair a dead pixel and accurately display images by connecting the OLED of the dead pixel disconnected from the dead pixel circuit to the repair pixel part.

The scan driving unit 200 provides scan signals to the display pixel circuits via the scan lines SL1 through SLn.

The data driving unit 300 provides data signals to the display pixel circuits via the data lines DL1 through DLn.

The emission driving unit 400 provides emission signals to the display pixel circuits via the emission lines EM1 through EMn.

The power supply unit 500 provides a high power voltage ELVDD, a low power voltage ELVSS, and an initial voltage Vint to each of the pixels P via power lines.

The timing control unit 600 generates control signals CTL1, CTL2, CTL3, and CTL4. The timing control unit 600 respectively provides the control signals CTL1, CTL2, CTL3, and CTL4 to the scan driving unit 200, the data driving unit 300, the emission driving unit 400 and the power supply unit 500 to control these units.

Figure 2:
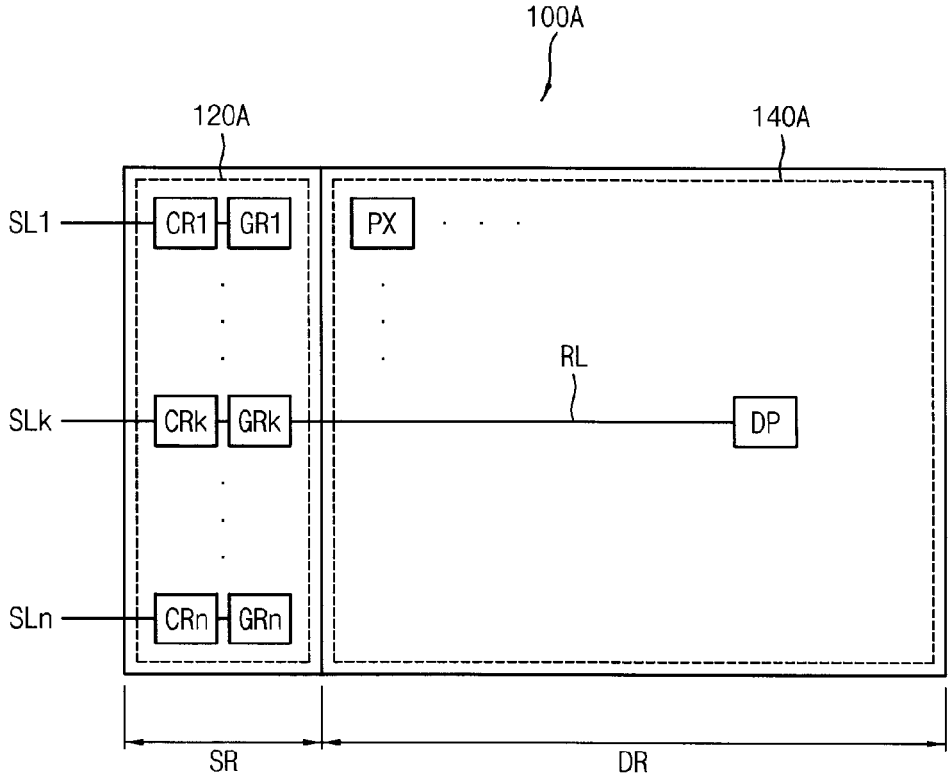
FIG. 2 is a block diagram illustrating an example of an OLED display panel included in the OLED display of FIG. 1.
Figure 3:
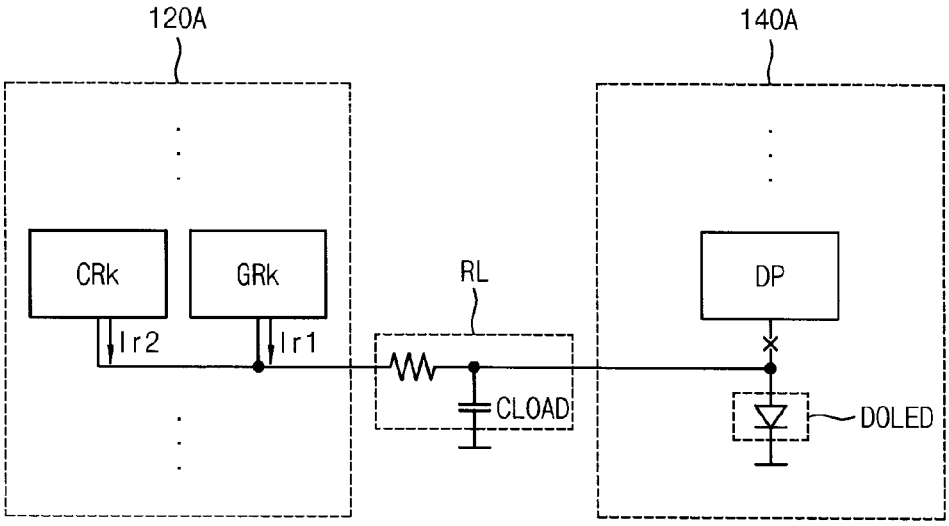
FIG. 3 is a block diagram illustrating an example of a dead pixel and a repair pixel part included in an OLED display panel of FIG. 2.
Figure 4:
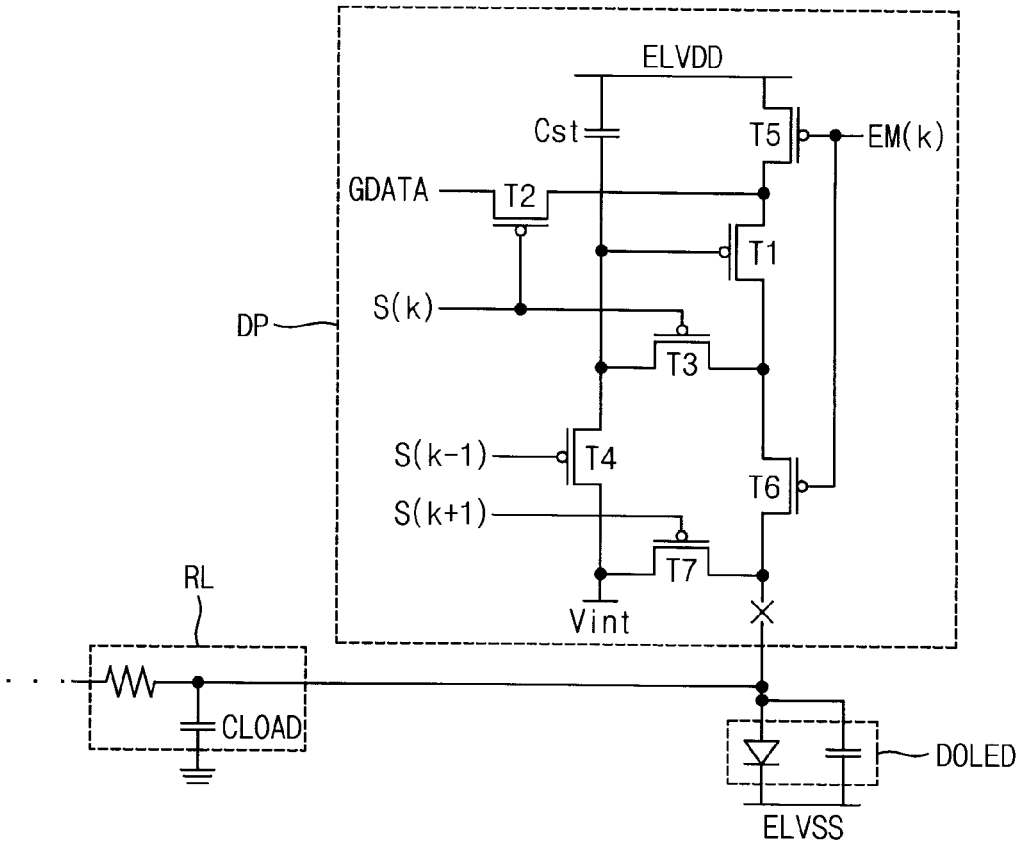
FIG. 4 is a circuit diagram illustrating an example of the dead pixel of FIG. 3.
Figure 5:
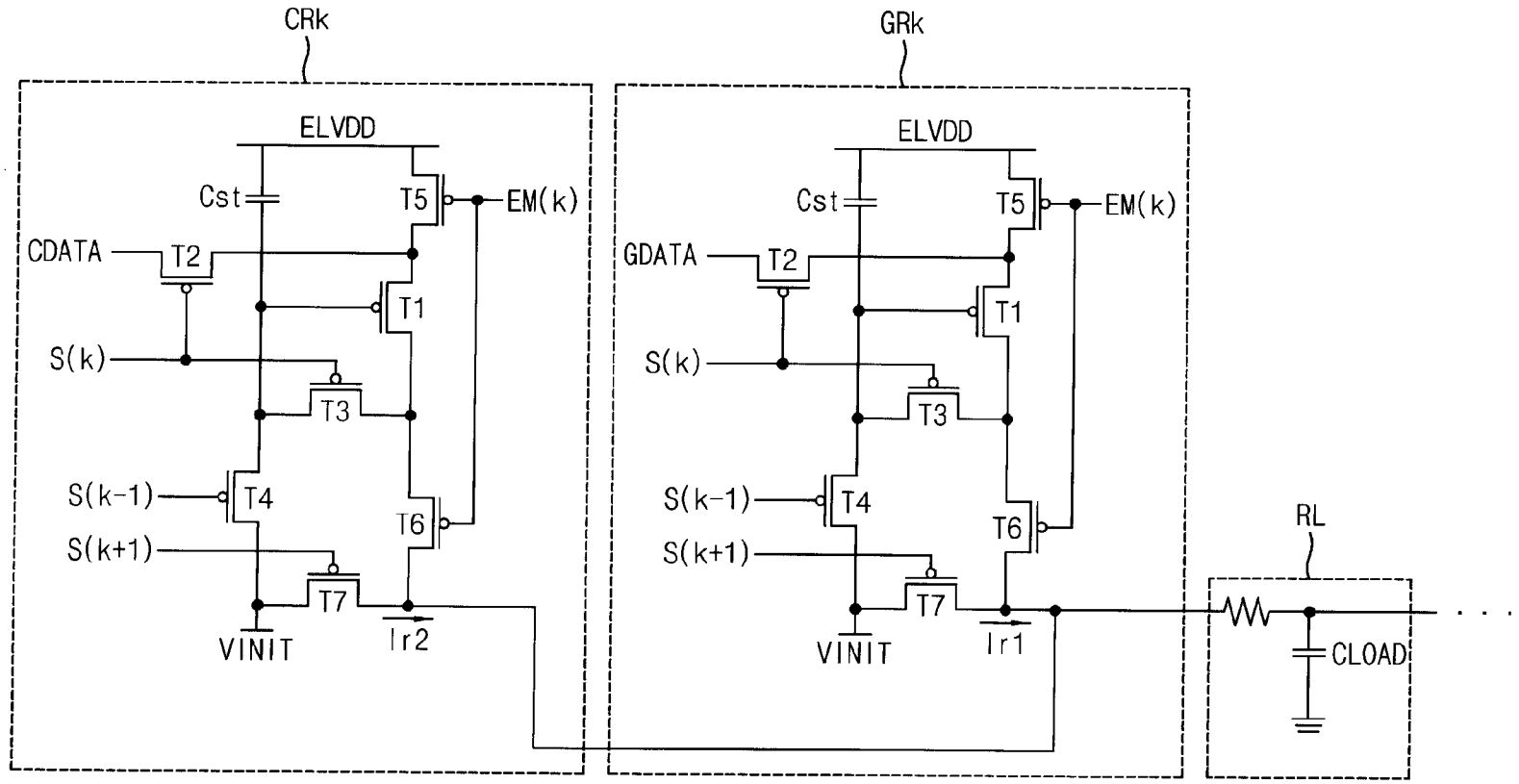
FIG. 5 is a circuit diagram illustrating an example of the repair pixel part of FIG. 3.

FIG. 2 is a block diagram illustrating an example of an OLED display panel included in the OLED display of FIG. 1. FIG. 3 is a block diagram illustrating an example of a dead pixel and a repair pixel part included in the OLED display panel of FIG. 2. FIG. 4 is a circuit diagram illustrating an example of the dead pixel of FIG. 3. FIG. 5 is a circuit diagram illustrating an example of the repair pixel part of FIG. 3.

Referring to FIGS. 2 through 5, a repair pixel part 120A of the OLED display panel 100A includes a plurality of grayscale repair pixel circuits or grayscale pixel repair circuits GR1 through GRn and a plurality of compensation repair pixel circuits or compensation pixel repair circuits CR1 through CRn to accurately displaying images by repairing the dead pixel.

As shown in FIGS. 2 and 3, the OLED display panel 100A is divided into a display region DR and a peripheral region SR surrounding the display region DR. For example, the OLED display panel 100A includes a substrate including the display region DR where an image is displayed and the peripheral region SR surrounding the display region DR. The OLED display panel 100A includes a display pixel part 140A located in the display region DR and the repair pixel part 120A located in the peripheral region SR.

The display pixel part 140A includes a plurality of OLEDs and a plurality of display pixel circuits PX respectively connected to the OLEDs. If at least one of the display pixel circuits PX is a dead pixel circuit DP, the dead pixel circuit DP is disconnected from the OLED of the dead pixel DOLED, and the OLED of the dead pixel DOLED is connected to a repair line RL.

The repair pixel part 120A provides the OLED of the dead pixel DOLED with a grayscale repair current Ir1 for representing a grayscale of the image and a compensation repair current Ir2 for compensating a line load of the repair line RL via the repair line RL. The repair pixel part 120A includes the first through (n)th grayscale repair pixel circuits GR1 through GRn and the first through (n)th compensation repair pixel circuits CR1 through CRn.

The (k)th grayscale repair pixel circuit GRk is connected to the OLED of the dead pixel DOLED and provides the grayscale repair current Ir1 to the OLED of the dead pixel DOLED in response to the (k)th scan signal, where k is an integer greater than or equal to 1, and less than or equal to n. Thus, the (k)th grayscale repair pixel circuit GRk receives a scan signal and a data signal instead of the dead pixel circuit DP and provides the grayscale repair current Ir1 to the OLED of the dead pixel DOLED so as to display images. Here, the grayscale repair current Ir1 is provided to the OLED of the dead pixel DOLED via the repair line RL such that the OLED of the dead pixel DOLED represents the grayscale of image. The magnitude of the grayscale repair current Ir1 is substantially equal to magnitude of the driving current generated by a normal display pixel circuit. However, current losses of the grayscale repair current Ir1 may occur due to the line load of the repair line RL.

The (k)th compensation repair pixel circuit CRk is connected to the OLED of the dead pixel DOLED disconnected from the dead pixel circuit DP and provides the compensation repair current Ir2 to the OLED of the dead pixel DOLED in response to the (k)th scan signal. Thus, the (k)th compensation repair pixel circuit CRk generates the compensation repair current Ir2 and provides the compensation repair current Ir2 to the OLED of the dead pixel DOLED so as to compensate the current losses due to the line load of the repair line RL. Here, the compensation repair current Ir2 is a current for compensating the line load of the repair line RL. The line load of the repair line RL is affected by the load resistance and load capacitor CLOAD of the repair line RL.

In one example embodiment, the (k)th grayscale repair pixel circuit GRk and the (k)th compensation repair pixel circuit CRk are connected to the same repair line RL. Thus, the OLED of the dead pixel DOLED can be repaired by the (k)th grayscale repair pixel circuit GRk and the (k)th compensation repair pixel circuit CRk that are located on the same scan line. For example, to repair the dead pixel located on the (k)th scan line, the (k)th grayscale repair pixel circuit GRk and the (k)th compensation repair pixel circuit CRk that are connected to the (k)th scan line provide the grayscale repair current Ir1 and the compensation repair current Ir2 to the OLED of the dead pixel DOLED in response to the (k)th scan signal.

As shown in FIG. 4, the display pixel circuit PX or the dead pixel circuit DP includes a plurality of transistors and a driving capacitor Cst. For example, the display pixel circuit PX or the dead pixel circuit DP includes a first transistor T1 connected to the a high power voltage ELVDD and an anode electrode of the OLED and applying a driving current corresponding to a grayscale data signal GDATA to the OLED. The display or dead pixel circuit PX or DP further includes a second transistor T2 connected to a source electrode of the first transistor T1 and data line, a third transistor T3 connected to a gate electrode and a drain electrode of the first transistor T1 and a fourth transistor T4 connected to an initial voltage Vint and the gate electrode of the first transistor T1. The display or dead pixel circuit PX or DP also includes a fifth transistor T5 connected to the high power voltage ELVDD and the source electrode of the first transistor T1, a sixth transistor T6 connected to the drain electrode of the first transistor T1 and the anode electrode of the OLED and a seventh transistor T7 connected to the initial voltage Vint and the anode electrode of the OLED.

Specifically, the fourth transistor T4 applies the initial voltage Vint to the driving capacitor Cst and the gate electrode of the first transistor T1 in response to the (k−1)th scan signal S(k−1) so as to reset the driving capacitor Cst and the gate electrode of the first transistor T1 to the initial voltage Vint.

The second transistor T2 applies the grayscale data signal GDATA to the first transistor T1 in response to the (k)th scan signal S(k).

The third transistor T3 compensates for the threshold voltage of the first transistor T1 in response to the (k)th scan signal S(k) by connecting the gate electrode and the drain electrode of the first transistor T1 (i.e., a diode connection of the first transistor T1). Because the second transistor T2 and the third transistor T3 receive the (k)th scan signal S(k), the grayscale data signal GDATA can be applied while the threshold voltage of the first transistor T1 is compensated.

The first transistor T1 provides the driving current corresponding to the grayscale data signal GDATA to the OLED.

The sixth transistor T6 is located between the drain electrode of the first transistor T1 and the anode electrode of the OLED. The sixth transistor T6 controls emission of the OLED in response to a (k)th emission signal.

The seventh transistor T7 applies the initial voltage Vint to the anode electrode of the OLED in response to the (k+1)th scan signal S(k+1) to reset the anode electrode of the OLED to the initial voltage Vint.

When the display pixel circuit is broken or shorted, the driving current may be not provided to the OLED and the display pixel circuit may become a dead pixel circuit. To repair the dead pixel, the OLED of the dead pixel DOLED is disconnected from the dead pixel circuit DP and is connected to the repair pixel part 120A via the repair line RL. The repair line RL is affected by a load resistance and a load capacitor CLOAD of the repair line RL. Therefore, the repair pixel part 120A provides the compensation repair current Ir2 as well as the grayscale repair current Ir1 to the OLED of the dead pixel DOLED, thereby preventing luminance degradation due to the line load of the repair line RL.

As shown in FIG. 5, the repair pixel part 120A includes the (k)th grayscale repair pixel circuit GRk and the (k)th compensation repair pixel circuit CRk that are connected to the repair line RL.

The (k)th grayscale repair pixel circuit GRk provides the grayscale repair current Ir1 to the OLED of the dead pixel DOLED in response to the (k)th scan signal S(k). The same data signal is applied to the dead pixel circuit DP and the (k)th grayscale repair pixel circuit GRk. For example, the same data line is connected to the dead pixel circuit DP and the (k)th grayscale repair pixel circuit GRk.

In one example embodiment, the (k)th grayscale repair pixel circuit GRk has the same structure as the dead pixel circuit DP. For example, the (k)th grayscale repair pixel circuit GRk includes first through seventh transistors T1 through T7 and a driving capacitor Cst. The first through seventh transistors T1 through T7 and the driving capacitor Cst are described above, and thus duplicated descriptions thereof will be omitted.

The (k)th compensation repair pixel circuit CRk provides the compensation repair current Ir2 to the OLED of the dead pixel DOLED in response to the (k)th scan signal S(k). A compensation voltage CDATA for compensating the line load of the repair line RL is applied to the (k)th compensation repair pixel circuit CRk. In one example embodiment, the magnitude of the current losses occurring in the repair line RL substantially equals to the magnitude of the compensation repair current Ir2. Thus, the compensation voltage CDATA is controlled to compensate for the current losses occurred by the line load of the repair line RL.

In one example embodiment, the (k)th compensation repair pixel circuit CRk has the same structure as the dead pixel circuit DP. For example, the (k)th compensation repair pixel circuit CRk includes first through seventh transistors T1 through T7 and the driving capacitor Cst. The first through seventh transistors T1 through T7 and the driving capacitor Cst are described above, thus duplicated descriptions thereof will be omitted.

Therefore, in some embodiments, the (k)th grayscale repair pixel circuit GRk and the (k)th compensation repair pixel circuit CRk have the same structure as the dead pixel circuit DP. The magnitude of the grayscale repair current Ir1 generated by the (k)th grayscale repair pixel circuit GRk substantially equals to the driving current generated by the normal display pixel circuit. However, current losses of the grayscale repair current Ir1 may occur due to the line load of the repair line RL. Therefore, the (k)th compensation repair pixel circuit CRk can generate the compensation repair current Ir2 to compensate for the line load of the repair line RL.

Although the example embodiments of FIG. 5 describe that the (k)th grayscale repair pixel circuit GRk, the (k)th compensation repair pixel circuit CRk, and the dead pixel circuit DP have the same structure, the (k)th grayscale repair pixel circuit GRk, the (k)th compensation repair pixel circuit CRk, and the dead pixel circuit DP may have different structures from each other. For example, structures of the (k)th grayscale repair pixel circuit GRk and the (k)th compensation repair pixel circuit CRk may be simpler than the structure of the dead pixel circuit DP to reduce the size of the peripheral region SR.

Figure 6:
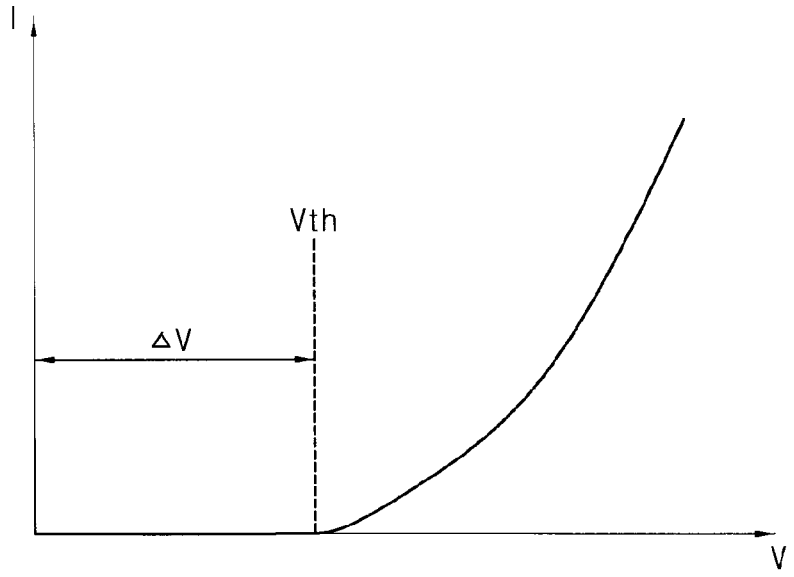
FIG. 6 is a graph showing current losses of a grayscale repair current by a line load of a repair line in the OLED display panel of FIG. 2.

FIG. 6 is a graph showing current losses of a grayscale repair current due to the line load of the repair line in the OLED display panel of FIG. 2.

Referring to FIG. 6, the graph illustrates the relationship between the grayscale voltage V applied to a grayscale repair pixel circuit and the grayscale repair current I provided to an OLED of the dead pixel. Current losses of the grayscale repair current I occur due to the line load of the repair line. Thus, the decreased grayscale repair current I is provided to the OLED of the dead pixel. The decreased grayscale repair current I may be calculated according to the following Equation 1.

$$I=Ir1-Cload*\Delta V/T \quad \text{Equation 1}$$

where, I is the decreased grayscale repair current provided to the OLED of the dead pixel, Ir1 is the grayscale repair current generated by the grayscale repair pixel circuit, Cload is the capacitance of the load capacitor, ΔV is the difference between the threshold voltage Vth of the OLED and the initial voltage, and T is one frame period.

The decreased grayscale repair current I provided to the OLED of the dead pixel is decreased in proportion to the capacitance of the load capacitor Cload. Thus, part of the grayscale repair current Ir1 generated by the grayscale repair pixel circuit is provided to the load capacitor and the rest of the grayscale repair current Ir1 is provided to the OLED of the dead pixel. Therefore, when the portion of the compensation repair current is not provided to the OLED of the dead pixel, the luminance of the OLED of the dead pixel is decreased and the dead pixel can be recognized by a viewer as a dark pixel.

Figure 7A:
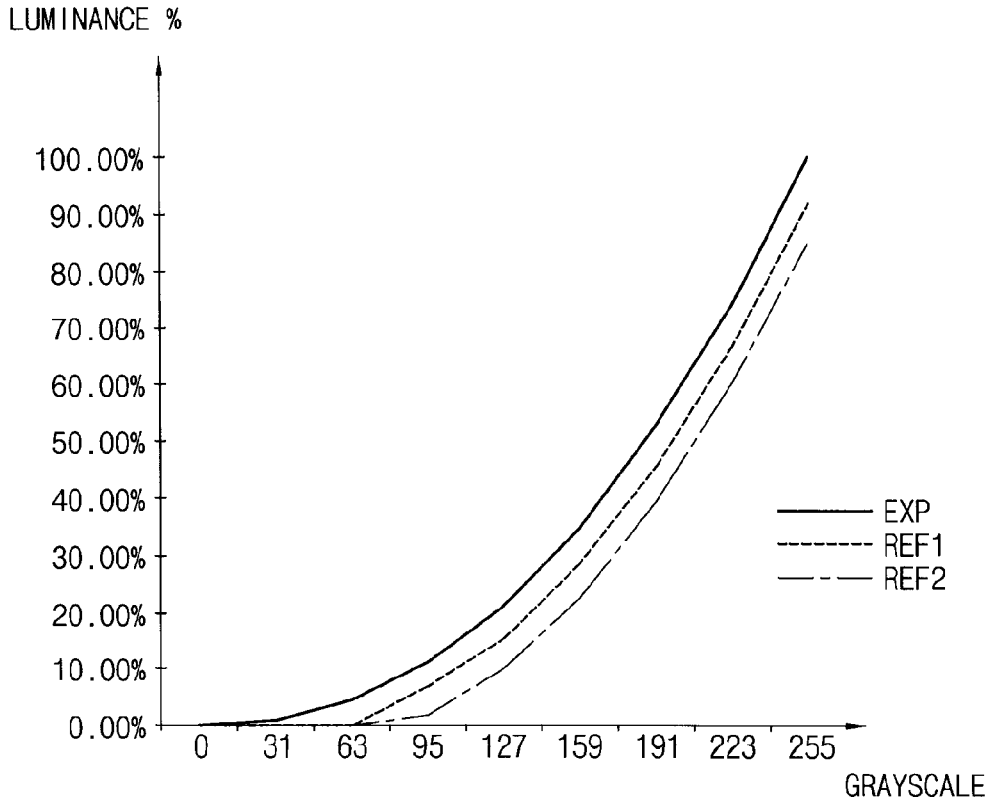
FIGS. 7*a* and 7*b* are graphs showing effectiveness of the OLED panel of FIG. 2.
Figure 7B:
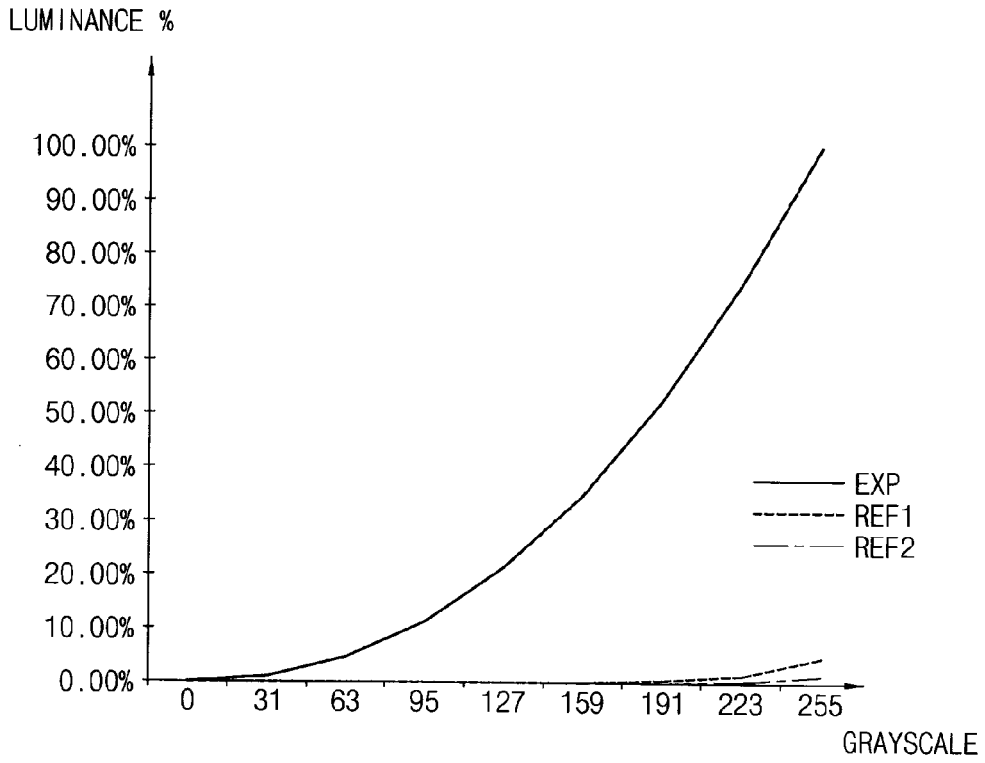

FIGS. 7*a* and 7*b* are graphs showing the effectiveness of the OLED display panel of FIG. 2.

Referring to FIGS. 7*a* and 7*b*, the OLED display panel including the repair pixel part providing a grayscale repair current and a compensation repair current can accurately display images and represent the grayscale of the images.

As shown in FIG. 7*a*, the luminance of a repaired dead pixel was measured in white grayscale of about 700 nit. An experimental OLED display panel EXP includes the repair pixel part providing a grayscale repair current and a compensation repair current. A first comparative OLED display panel REF1 includes a repair pixel part only providing the grayscale repair current and includes the repair line having load capacitor with a capacitance of about 30 pF. A second comparative OLED display panel REF2 includes a repair pixel part only providing the grayscale repair current and includes the repair line having a load capacitor with a capacitance of about 40 pF. In the experimental OLED display panel EXP, the luminance of the repaired dead pixel was maintained at the same level as the luminance of the normal pixel. Whereas, in the first comparative OLED display panel REF1, the luminance of the repaired dead pixel was decreased with respect to the normal pixel. In addition, in the second comparative OLED display panel REF2 having a relatively large load capacitance, the luminance of the repaired dead pixel was remarkably decreased with respect to the normal pixel.

As shown in FIG. 7*b*, the luminance of the repaired dead pixel was measured in white grayscale of 10 nit. In the experimental OLED display panel EXP, the luminance of the repaired dead pixel was maintained at the same level as the luminance of the normal pixel. Whereas, in the first comparative OLED display panel REF1, the luminance of the repaired dead pixel was decreased with respect to the normal pixel. In addition, in the second comparative OLED display panel REF2 having a relatively large load capacitance, the luminance of the repaired dead pixel was remarkably decreased with respect to the normal pixel.

Therefore, the OLED display panel including a repair pixel part providing a grayscale repair current and a compensation repair current can accurately represent the grayscale of the images in low white grayscale and large line load and prevent that the dead pixel from being recognized as a dark pixel.

Figure 8:
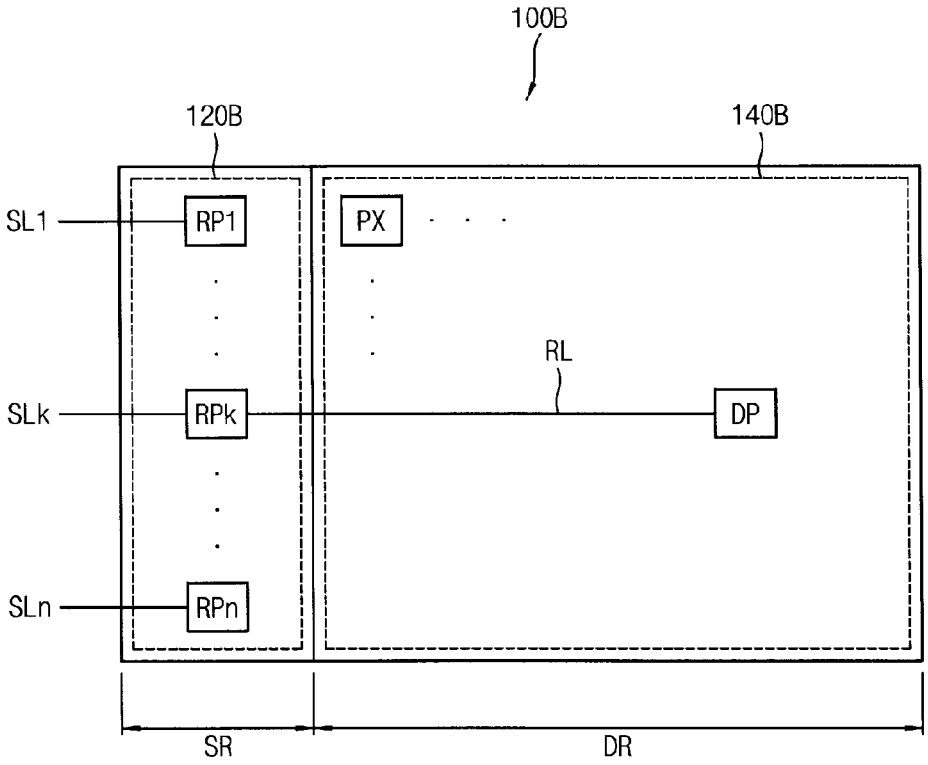
FIG. 8 is a block diagram illustrating another example of an OLED display panel included in the OLED display of FIG. 1.
Figure 9:
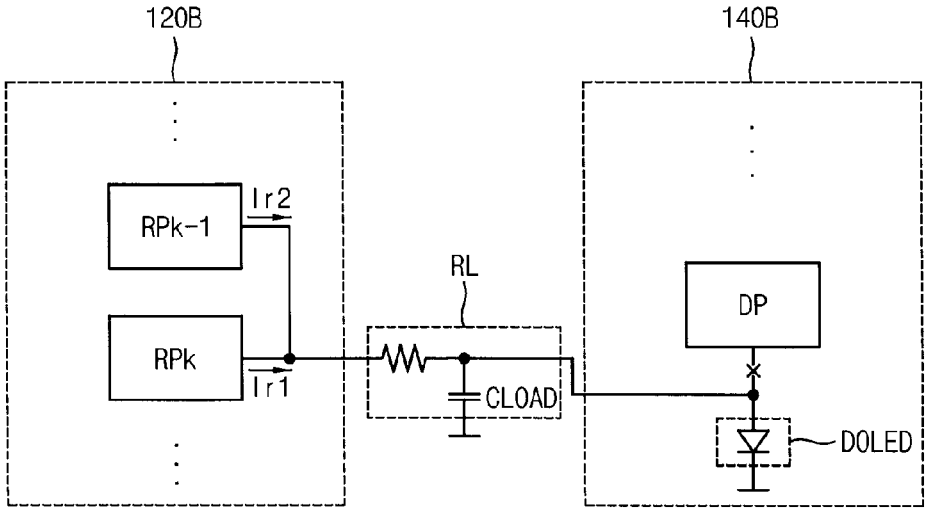
FIG. 9 is a block diagram illustrating an example of a dead pixel and a repair pixel part included in the OLED display panel of FIG. 8.
Figure 10:
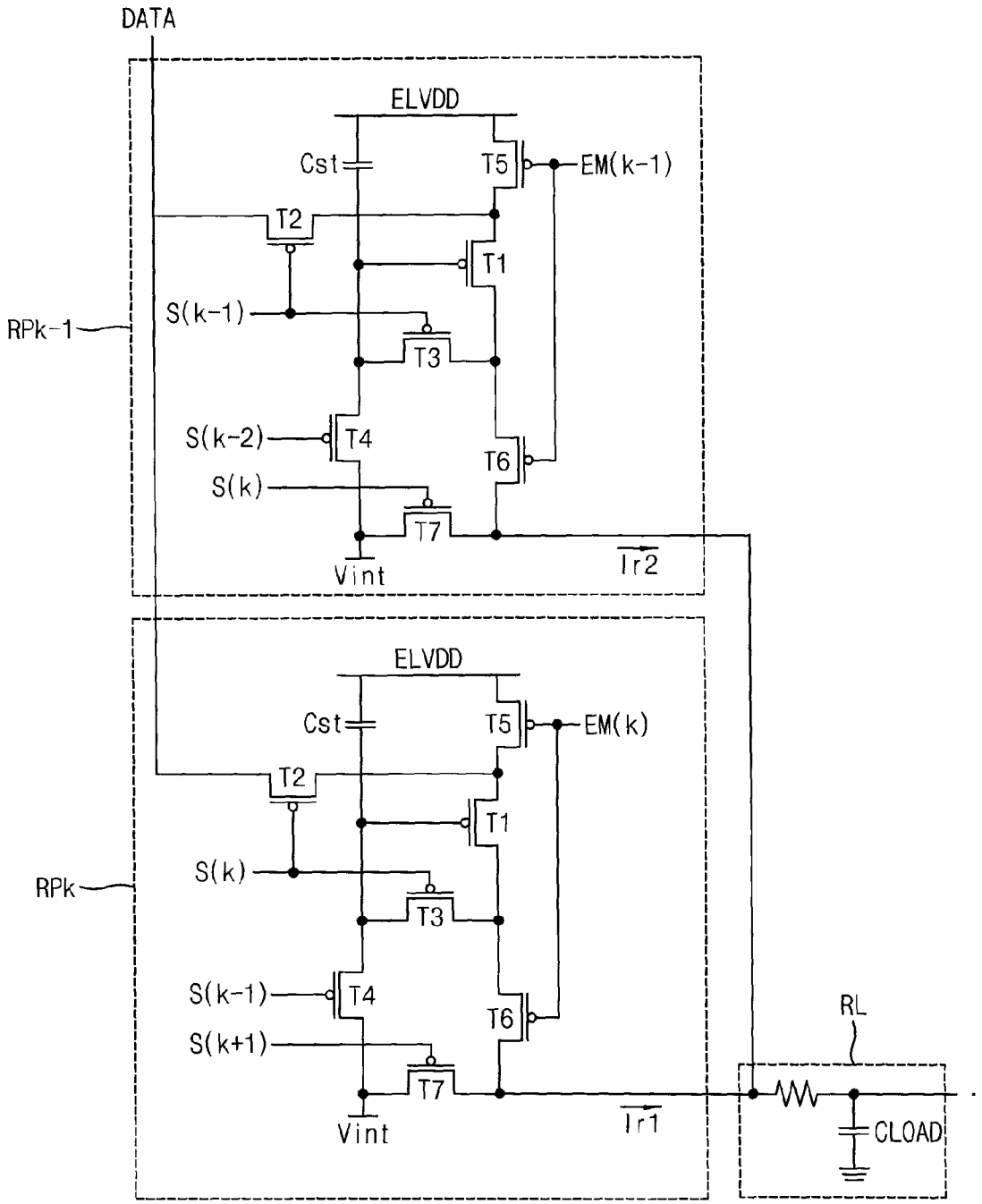
FIG. 10 is a circuit diagram illustrating an example of a repair pixel part of FIG. 9.
Figure 11:
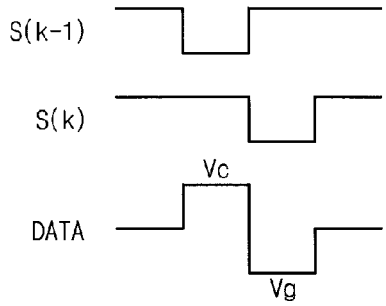
FIG. 11 is a waveform diagram illustrating an example of input signals applied to repair pixel part of FIG. 9.

FIG. 8 is a block diagram illustrating another example of an OLED display panel included in the OLED display of FIG. 1. FIG. 9 is a block diagram illustrating an example of a dead pixel and a repair pixel part included in the OLED display panel of FIG. 8. FIG. 10 is a circuit diagram illustrating an example of a repair pixel part of FIG. 9. FIG. 11 is a waveform diagram illustrating an example of input signals applied to repair pixel part of FIG. 9.

Referring to FIGS. 8 through 11, the repair pixel part 120B of the OLED display panel 100B includes a plurality of repair pixel circuits or sub-pixel repair circuits RP1 through RPn to represent a grayscale of the image by repairing the dead pixel.

As shown in FIGS. 8 and 9, the OLED display panel 100B is divided into a display region DR and a peripheral region SR surrounding the display region DR. For example, the OLED display panel 100B includes a substrate including the display region DR where an image is displayed and the peripheral region SR surrounding the display region DR. The OLED display panel 100B includes a display pixel part 140B located in the display region DR and the repair pixel part 120B located in the peripheral region SR.

The display pixel part 140B includes a plurality of OLEDs and a plurality of display pixel circuits PX respectively connected to the OLEDs. If at least one of the display pixel circuits PX is a dead pixel circuit DP, the dead pixel circuit DP is disconnected from the OLED of the dead pixel DOLED and the OLED of the dead pixel DOLED is connected to a repair line RL.

The repair pixel part 120B provides the OLED of the dead pixel DOLED with a grayscale repair current Ir1 for representing a grayscale of the image and a compensation repair current Ir2 for compensating a line load of the repair line RL via the repair line RL. The repair pixel part 120B includes first through (n)th repair pixel circuits RP1 through RPn.

Two repair pixel circuits that are adjacent to each other respectively provide the grayscale repair current Ir1 and the compensation repair current Ir2 to the OLED of the dead pixel DOLED. In one example embodiment, the (k)th repair pixel circuit RPk connected to the (k)th scan line provides the grayscale repair current Ir1 to the OLED of the dead pixel DOLED and the (k−1)th repair pixel circuit RPk−1 connected to the (k−1)th scan line provides the compensation repair current Ir2 to the OLED of the dead pixel DOLED, where k is an integer greater than or equal to 2, and less than or equal to n. Thus, the OLED of the dead pixel DOLED receives the grayscale repair current Ir1 from the (k)th repair pixel circuit RPk and the (k)th scan line is connected to the (k)th repair pixel circuit RPk and the dead pixel circuit DP. The OLED of the dead pixel DOLED receives the compensation repair current Ir2 from the (k−1) th repair pixel circuit RPk−1 connected to the previous scan line of the (k)th scan line.

The magnitude of the grayscale repair current Ir1 is substantially equal to magnitude of the driving current generated by a normal display pixel circuit. However, current losses of the grayscale repair current Ir1 may occur due to a line load of the repair line RL. Therefore, the compensation repair current Ir2 is provided to the OLED of the dead pixel DOLED using adjacent repair pixel circuit, thereby accurately representing a grayscale of the image.

The display pixel circuit PX or the dead pixel circuit DP includes a plurality of transistors T1 through T7 and a driving capacitor Cst. The first through seventh transistors T1 through T7 and the driving capacitor Cst are described above, and thus duplicated descriptions thereof will be omitted.

As shown in FIG. 10, the dead pixel circuit DP and the (k)th repair pixel circuit RPk are connected to the same scan line. The (k)th repair pixel circuit RPk provides the grayscale repair current Ir1 to the OLED of the dead pixel DOLED. The (k−1)th repair pixel circuit RPk−1 provides the compensation repair current Ir2 to the OLED of the dead pixel DOLED.

In some embodiments, each of the repair pixel circuits RP1 through RPn has substantially the same structure as the dead pixel circuit DP. For example, the (k)th repair pixel circuit RPk includes the first through seventh transistors T1 through T7 and the driving capacitor Cst. The first through seventh transistors T1 through T7 and the driving capacitor Cst are described above, and thus duplicated descriptions thereof will be omitted.

As shown in FIG. 11, a compensation voltage Vc for generating the compensation repair current Ir2 is applied to the (k−1) repair pixel circuit RPk−1 in response to the (k−1)th scan signal S(k−1). A grayscale voltage Vg for generating the grayscale repair current Ir1 is applied to the (k)th repair pixel circuit RPk in response to the (k)th scan signal S(k). Thus, the (k−1)th repair pixel circuit RPk−1 generates the compensation repair current Ir2 corresponding to the (k−1)th scan signal S(k−1) and provides the compensation repair current Ir2 to the OLED of the dead pixel DOLED. The (k)th repair pixel circuit RPk generates the grayscale repair current Ir1 corresponding to the (k)th scan signal S(k) and provides the grayscale repair current Ir1 to the OLED of the dead pixel DOLED. In one example embodiment, the compensation voltage Vc is determined by experiment such that magnitude of current losses occurring in the repair line RL substantially equals the magnitude of the compensation repair current Ir2.

Although, the example embodiments of FIGS. 9 through 11 describe that the compensation repair current Ir2 is generated by the (k−1)th repair pixel circuit RPk−1, the compensation repair current Ir2 can be generated by various methods. For example, when the dead pixel is located on the (k)th scan line, the (k)th repair pixel circuit located on the (k)th scan line can provide the grayscale repair current to the OLED of the dead pixel, where k is an integer greater than or equal to 1, and less than or equal to n−1. The (k+1)th repair pixel circuit located on the (k+1)th scan line can provide the compensation repair current to the OLED of the dead pixel. Thus, the OLED of the dead pixel receives the grayscale repair current from the (k)th repair pixel circuit and the (k)th repair pixel circuit RPk and the dead pixel circuit DP are located on the same scan line. The OLED of the dead pixel receives the compensation repair current from the (k+1)th repair pixel circuit RPk+1 located on the next scan line of the (k)th scan line. Here, a grayscale voltage for generating the grayscale repair current is applied to the (k)th repair pixel circuit in response to the (k)th scan signal. A compensation voltage for generating the compensation repair current is applied to the (k+1) repair pixel circuit in response to the (k+1)th scan signal.

Figure 12:
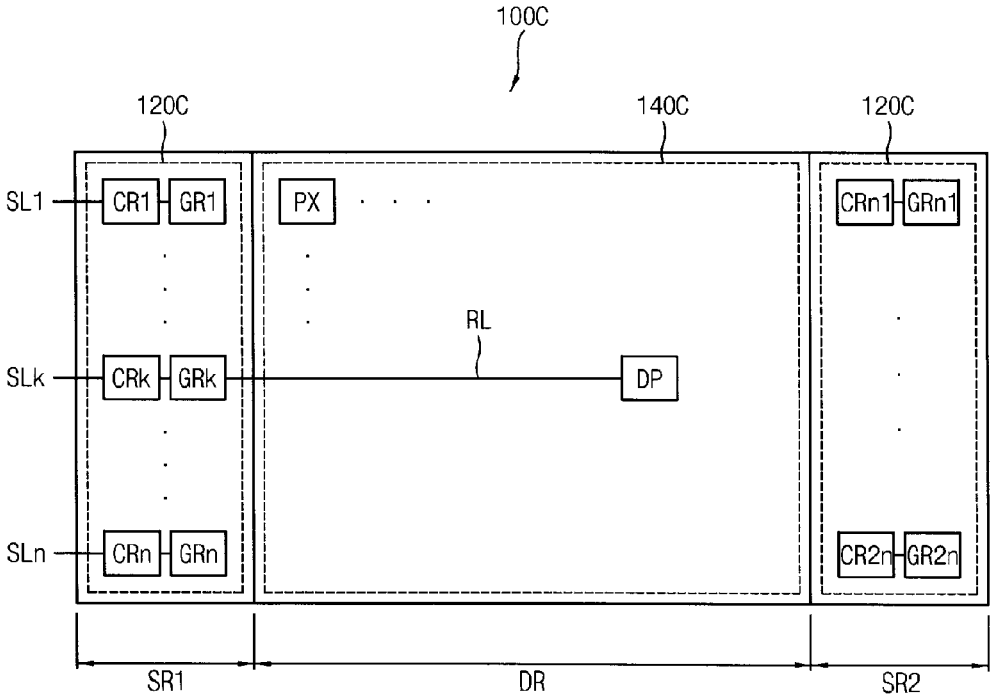
FIG. 12 is a block diagram illustrating still another example of an OLED display panel included in the OLED display of FIG. 1.

FIG. 12 is a block diagram illustrating still another example of an OLED display panel included in the OLED display of FIG. 1.

Referring to FIG. 12, the repair pixel part 120C is located in a first peripheral region SR1 and a second peripheral region SR2 that are adjacent to both sides of the display region DR facing each other. The repair pixel part 120C includes a plurality of grayscale repair pixel circuits GR1 through GR2*n* and a plurality of compensation repair pixel circuits CR1 through CR2*n* to accurately display images and represent a grayscale of the image by repairing the dead pixel.

The OLED display panel 100C is divided into the display region DR and a peripheral region surrounding the display region DR. For example, the OLED display panel 100C includes a substrate including the display region DR where an image is displayed and the peripheral region surrounding the display region DR. The peripheral region includes the first peripheral region SR1 and the second peripheral region SR2 that are adjacent to both sides of the display region DR facing each other. The OLED display panel 100C includes a display pixel part 140C located in the display region DR and the repair pixel part 120C located in the first peripheral region SR1 and the second peripheral region SR2.

The display pixel part 140C includes a plurality of OLEDs and a plurality of display pixel circuits PX respectively connected to the OLEDs. If at least one of the display pixel circuits PX is a dead pixel circuit DP, the dead pixel circuit DP is disconnected from an OLED of the dead pixel DOLED and the OLED of the dead pixel DOLED is connected to a repair line RL.

The repair pixel part 120C is located in the first peripheral region SR1 and the second peripheral region SR2. The repair pixel part 120C includes the grayscale repair pixel circuits GR1 through GR2*n* and the compensation repair pixel circuits CR1 through CR2*n* such that a large number of dead pixels can be repaired and the areas of both sides of the OLED display are substantially the same. The (k)th grayscale repair pixel circuit GRk is connected to the OLED of the dead pixel DOLED and provides the grayscale repair current Ir1 to the OLED of the dead pixel DOLED, where k is an integer greater than or equal to 1, and less than or equal to n. The (k)th compensation repair pixel circuit CRk is connected to the OLED of the dead pixel DOLED and provides the compensation repair current Ir2 to the OLED of the dead pixel DOLED. The structures of the (k)th grayscale repair pixel circuit GRk and the (k)th compensation repair pixel circuit CRk to repair the OLEDs are described above, and thus duplicated descriptions thereof will be omitted.

The example embodiments of FIG. 12 describe that the repair pixel part 120C include n grayscale repair pixel circuits and n compensation repair pixel circuits that are respectively connected to the n scan lines on each the first peripheral region SR1 and first peripheral region SR2. However, in some embodiments, the OLED display panel includes a number of grayscale repair pixel circuits and compensation repair pixel circuits which is a multiple of the number of scan lines. Therefore, in these embodiments, the repair pixel part includes first through (r*n)th grayscale repair pixel circuits located in the first peripheral region, (r*n+1)th through (2r*n)th grayscale repair pixel circuits located in the second peripheral region, first through (r*n)th compensation repair pixel circuits located in the first second peripheral region, and (r*n+1)th through (2r*n)th compensation repair pixel circuits located in the second peripheral region, where n is an integer greater than 1, and r is an integer greater than 1.

Figure 13:
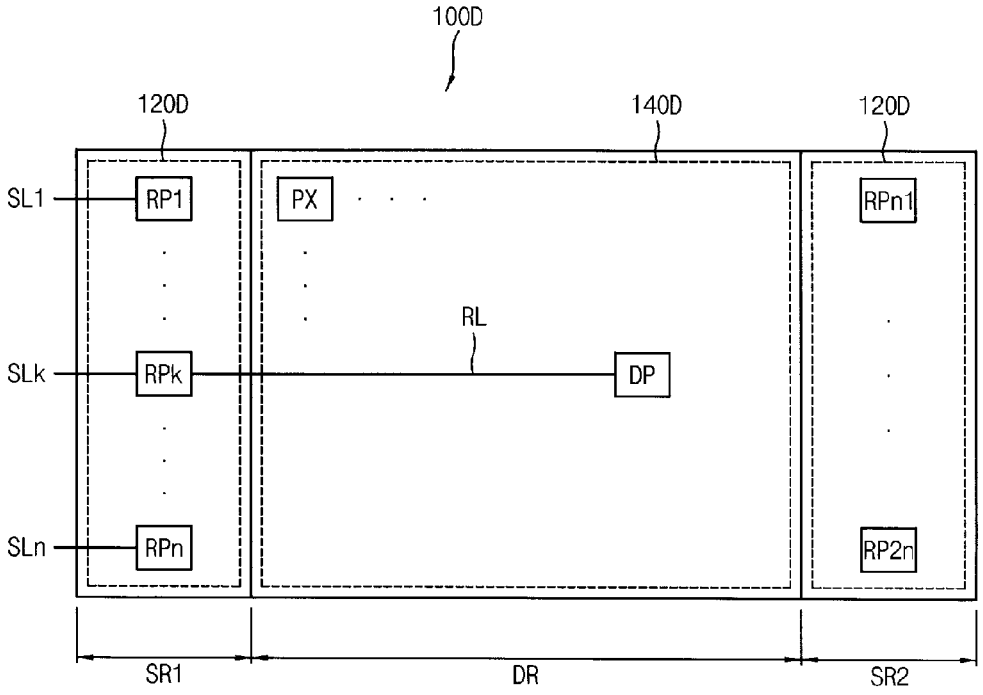
FIG. 13 is a block diagram illustrating still another example of an OLED display panel included in the OLED display device of FIG. 1.

FIG. 13 is a block diagram illustrating still another example of an OLED display panel included in the OLED display of FIG. 1.

Referring to FIG. 13, the repair pixel part 120D is located in a first peripheral region SR1 and a second peripheral region SR2 that are adjacent to both sides of the display region DR facing each other. The repair pixel part 120D includes a plurality of repair pixel circuits RP1 through RP2*n* to accurately display images and represent a grayscale of the image by repairing the dead pixel.

The OLED display panel 100D is divided into the display region DR and a peripheral region surrounding the display region DR. For example, the OLED display panel 100D includes a substrate including the display region DR where an image is displayed and the peripheral region surrounding the display region DR. The peripheral region includes the first peripheral region SR1 and the second peripheral region SR2 that are adjacent to both sides of the display region DR facing each other. The OLED display panel 100D includes a display pixel part 140D located in the display region DR and the repair pixel part 120D located in the first peripheral region SR1 and the second peripheral region SR2.

The display pixel part 140D includes a plurality of OLEDs and a plurality of display pixel circuits PX respectively connected to the OLEDs. If at least one of the display pixel circuits PX is a dead pixel circuit DP, the dead pixel circuit DP is disconnected from the OLED of the dead pixel DOLED and the OLED of the dead pixel DOLED is connected to a repair line RL.

The repair pixel part 120D is located in the first peripheral region SR1 and the second peripheral region SR2 and includes the repair pixel circuits RP1 through RP2*n* such that a large number of dead pixels can be repaired and the areas of both sides of the OLED display are substantially the same. The grayscale repair current Ir1 and the compensation repair current Ir2 are provided to the OLED of the dead pixel DOLED using the adjacent repair pixel circuit. The structures including the repair pixel circuits to repair the OLED are described above, and thus duplicated descriptions thereof will be omitted.

The example embodiments of FIG. 13 describe that the repair pixel part 120D includes n repair pixel circuits that are respectively connected to the n scan lines on each the first peripheral region SR1 and first peripheral region SR2. However, in some embodiments, the OLED display panel includes a number of repair pixel circuits that is a multiple of the number of scan lines. Therefore, the repair pixel part may include first through (r*n)th repair pixel circuits located in the first peripheral region and (r*n+1)th through (2r*n)th repair pixel circuits located in the second peripheral region, where n is an integer greater than 1 and r is an integer greater than 1.

The described technology may be applied to an electronic device having an OLED display. For example, the described technology may be applied to a television, a computer monitor, a laptop, a cellular phone, a smart phone, a smart pad, a personal digital assistant (PDA), a portable multimedia player (PMP), an MP3 player, a navigation system, a game console, a video phone, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the inventive technology. Accordingly, all such modifications are intended to be included within the scope of the invention as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. An organic light-emitting diode (OLED) display panel, comprising:

a substrate including a display region configured to display an image and a peripheral region surrounding the display region;

a plurality of OLEDs formed in the display region;

a plurality of pixel circuits formed in the display region and respectively connected to the OLEDs;

a pixel repair circuit formed in the peripheral region; and a plurality of repair lines that extend between the pixel repair circuit and the OLEDs, wherein, when one of the pixel circuits is a dead pixel circuit, the dead pixel circuit is disconnected from a corresponding dead pixel OLED and the dead pixel OLED is connected to a corresponding repair line, and wherein the pixel repair circuit is configured to provide the dead pixel OLED with i) a grayscale repair current for representing a grayscale of the image and ii) a compensation repair current for compensating a line load of the repair line.

2. The display panel of claim 1, wherein the pixel repair circuit comprises:

first through (n)th grayscale pixel repair circuits configured to respectively receive first through (n)th scan signals, wherein one of the grayscale pixel repair circuits is i) connected to the dead pixel OLED via the corresponding repair line and ii) configured to provide the grayscale repair current to the dead pixel OLED in response to the corresponding scan signal, where n is an integer greater than 1; and first through (n)th compensation pixel repair circuits configured to respectively receive the scan signals, wherein one of the compensation pixel repair circuits is i) connected to the dead pixel OLED via the corresponding repair line and ii) configured to provide the compensation repair current to the dead pixel OLED in response to the corresponding scan signal.

3. The display panel of claim 2, wherein a (k)th grayscale pixel repair circuit is configured to receive a (k)th scan signal, wherein a (k)th compensation pixel repair circuit is configured to receive the (k)th scan signal, and wherein the (k)th grayscale pixel repair circuit and the (k)th compensation pixel repair circuit are connected to the same repair line, where k is an integer greater than or equal to 1 and less than or equal to n.

4. The display panel of claim 2, wherein the dead pixel circuit is configured to receive a data signal and wherein the one of the grayscale pixel repair circuits is configured to receive the data signal.

5. The display panel of claim 2, wherein a data line is connected to the dead pixel circuit and the one of the grayscale pixel repair circuits.

6. The display panel of claim 2, wherein the one of the grayscale pixel repair circuits has substantially the same structure as the dead pixel circuit.

7. The display panel of claim 2, wherein the one of the grayscale pixel repair circuits has a different structure from that of the dead pixel circuit.

8. The display panel of claim 1, wherein the pixel repair circuit includes:

first through (n)th sub-pixel repair circuits configured to respectively receive first through (n)th scan signals, wherein each of the sub-pixel repair circuits is configured to generate a corresponding grayscale repair current or a corresponding compensation repair current, where n is an integer greater than 1.

9. The display panel of claim 8, wherein a (k)th sub-pixel repair circuit is configured to receive a (k)th scan signal, wherein the dead pixel circuit is configured to receive the (k)th scan signal, where k is an integer greater than or equal to 2 and less than or equal to n, wherein the (k)th sub-pixel repair circuit is further configured to provide the grayscale repair current to the dead pixel OLED, and wherein a (k−1)th sub-pixel repair circuit is configured to: i) receive a (k−1)th scan signal and ii) provide the compensation repair current to the dead pixel OLED.

10. The display panel of claim 9, wherein the (k−1)th sub-pixel repair circuit is further configured to receive a compensation voltage for generating the compensation repair current in response to the (k−1)th scan signal and wherein the (k)th sub-pixel repair circuit is further configured to receive a grayscale voltage for generating the grayscale repair current in response to the (k)th scan signal.

11. The display panel of claim 8, wherein a (k)th sub-pixel repair circuit is configured to receive a (k)th scan signal, wherein the dead pixel circuit is configured to receive the (k)th scan signal, where k is an integer greater than or equal to 1 and less than or equal to n−1, wherein the (k)th sub-pixel repair circuit is further configured to provide the grayscale repair current to the dead pixel OLED, and wherein a (k+1)th sub-pixel repair circuit is configured to i) receive a (k+1)th scan signal and ii) provide the compensation repair current to the dead pixel OLED.

12. The display panel of claim 11, wherein the (k)th sub-pixel repair circuit is further configured to receive a grayscale voltage for generating the grayscale repair current in response to the (k)th scan signal and wherein the (k+1)th sub-pixel repair circuit is further configured to receive a compensation voltage for generating the compensation repair current in response to the (k+1)th scan signal.

13. The display panel of claim 1, wherein the magnitude of current losses occurring in the repair line is substantially equal to the magnitude of the compensation repair current.

14. The display panel of claim 1, wherein the peripheral region includes a first peripheral region and a second peripheral region that are respectively adjacent to opposing sides of the display region and wherein the pixel repair circuit is located in the each of the first and second peripheral regions.

15. The display panel of claim 14, wherein the pixel repair circuit comprises:

first through (r*n)th grayscale pixel repair circuits located in the first peripheral region, where n is an integer greater than 1 and r is an integer greater than 1;

(r*n+1)th through (2r*n)th grayscale pixel repair circuits located in the second peripheral region;

first through (r*n)th compensation pixel repair circuits located in the first peripheral region; and (r*n+1)th through (2r*n)th compensation pixel repair circuits located in the second peripheral region.

16. The display panel of claim 14, wherein the pixel repair circuit comprises:

first through (r*n)th sub-pixel repair circuits located in the first peripheral region, where n is an integer greater than 1 and r is an integer greater than 1; and (r*n+1)th through (2r*n)th sub-pixel repair circuits located in the second peripheral region.

17. An organic light-emitting diode (OLED) display, comprising:

an OLED display panel;

a scan driver;

a data driver; and a timing controller, wherein the OLED display panel includes:

a substrate including a display region configured to display an image and a peripheral region surrounding the display region;

a plurality of OLEDs formed in the display region;

a plurality of pixel circuits formed in the display region and respectively connected to the OLEDs;

a pixel repair circuit located in the peripheral region; and a plurality of repair lines that extend between the pixel repair circuit and the OLEDs, wherein, when one of the pixel circuits is a dead pixel circuit, the dead pixel circuit is disconnected from a corresponding dead pixel OLED and the dead pixel OLED is connected to a corresponding repair line, and wherein the pixel repair circuit is configured to provide the dead pixel OLED with i) a grayscale repair current for representing a grayscale of the image and ii) a compensation repair current for compensating a line load of the repair line.

18. The display device of claim 17, wherein the magnitude of current losses occurring in the repair line is substantially equal to the magnitude of the compensation repair current.

19. The display device of claim 17, wherein the pixel repair circuit comprises:

first through (n)th grayscale pixel repair circuits configured to respectively receive first through (n)th scan signals, wherein one of the grayscale pixel repair circuits is i) connected to the dead pixel OLED via the corresponding repair line and ii) configured to provide the grayscale repair current to the dead pixel OLED in response to the corresponding scan signal, where n is an integer greater than 1; and first through (n)th compensation pixel repair circuits configured to respectively receive the scan signals, wherein one of the compensation pixel repair circuits is i) connected to the dead pixel OLED via the corresponding repair line and ii) configured to provide the compensation repair current to the dead pixel OLED in response to the corresponding scan signal.

20. The display device of claim 17, wherein the pixel repair circuit comprises:

first through (n)th sub-pixel repair circuits respectively configured to receive first through (n)th scan signals, wherein each of the sub-pixel repair circuits is configured to generate a corresponding grayscale repair current or a corresponding compensation repair current, where n is an integer greater than 1.

* * * * *